United States Patent [19]

Olon et al.

[11] Patent Number: 5,023,515

[45] Date of Patent: Jun. 11, 1991

[54] REDUNDANT LAMP CONTROL CIRCUIT

[75] Inventors: Thomas E. Olon, Fairview; Carl C. Krihwan, Erie, both of Pa.

[73] Assignee: American Sterilizer Company, Erie, Pa.

[21] Appl. No.: 495,236

[22] Filed: Mar. 16, 1990

[51] Int. Cl.[5] ..... F21V 19/04

[52] U.S. Cl. ..... 315/88; 362/20; 362/804

[58] Field of Search ..... 315/88, 89, 90, 91, 315/92, 93; 362/20, 254, 804

[56] References Cited

U.S. PATENT DOCUMENTS

| | | | |
|---|---|---|---|
| 3,471,745 | 10/1969 | Meyer | 315/88 |
| 3,577,173 | 5/1971 | Blomgren | 362/20 X |
| 4,410,929 | 10/1983 | Feinbloom et al. | 362/804 X |
| 4,458,179 | 7/1984 | Bainbridge et al. . | |
| 4,734,625 | 3/1988 | Geanous et al. . | |
| 4,757,426 | 7/1988 | Scheller et al. | 362/804 X |

OTHER PUBLICATIONS

Pamphlet-Chromophare Models C959 and C570, "A New Era in Surgical Lighting" Martin.

*Primary Examiner*—Robert J. Pascal
*Attorney, Agent, or Firm*—Kirkpatrick & Lockhart

[57] ABSTRACT

A circuit for energizing either a first or second lamp and for energizing a motor to position the energized lamp is comprised of first and second switches for supplying current to one of the lamps. Current sensors are provided to monitor the flow of current through each of the lamps. When current is flowing through one lamp and its associated switch, a biasing network assures that the other switch remains open. Upon the failure of the energized lamp, the other lamp is energized, a motor is energized so that the other lamp may be moved to a desired position within the optical system, and a visible indication that the lamp has failed open is provided.

5 Claims, 5 Drawing Sheets

20
$V_{in}$
21
V. Reg.
22
$V_r$
$V_r$
26
24
$V_{Q2}$
$V_{Q1}$
Limit Switches
56
Steering Diodes
54
1st. Driver
46
52
$V_{dr2}$
$V_{dr1}$
2nd. Driver
50
2nd. Bias Net-work
48
1st. Bias Net-work
44
2nd. Power Sw.
30
1st. Power Sw.
28
$I_2$
$I_1$
2nd. I Sensor
34
1st. I Sensor
32
$V_2$
$V_1$
$V_3$
Comp.
42
Comp.
40
2nd. Ref.
38
1st. Ref.
36
$V_{ref2}$
$V_{ref1}$
Lamp Burnout Det./Ind.
58

REDUNDANT LAMP CONTROL CIRCUIT

BACKGROUND OF THE INVENTION

1. Field of the Invention

The present invention is directed generally to optical systems and more particularly to optical systems having more than one light source.

CROSS REFERENCE TO RELATED APPLICATION

The present application is related to U.S. patent application Ser. No. 495,246, filed concurrently herewith, entitled Redundant Lamp Mechanism, and assigned to the same assignee as the present invention.

DESCRIPTION OF THE PRIOR ART

In various types of optical systems it is desirable to have multiple or redundant lamps. The provision of redundant lamps enables the optical system to continue functioning in the event that the primary lamp should fail. Such a feature is particularly desirable in, for example, surgical lights.

In U.S. Pat. No. 4,734,625, a control circuit is disclosed which controls the operation of electric lights. The control circuit may be used in conjunction with a surgical light including a lamp having two filaments. Each filament is arranged in the lamp so that it provides an illumination pattern of a different type. In the event that one of the filaments fails, the other filament is automatically energized thereby enabling the light to continue operation. Although such a light can continue operating in the event of a filament failure, the pattern for which the failed filament was responsible can no longer be used.

Another example of a controller used for controlling the operation of a multi-filament lamp is found in U.S. Pat. No. 4,458,179.

Another way to address the problem is to provide multiple lamps rather than lamps having multiple filaments. A surgical light utilizing multiple lamps is sold by Martin under the trademark CHROMOPHARE. The CHROMOPHARE lights sold under model nos. C950 and C570 are equipped with, auxiliary lamps. Should a lamp burn out, a relay switch energizes one of the auxiliary lamps.

Whether a light is provided with a lamp having multiple filaments or multiple lamps, the light will not perform in exactly the same manner as with the primary filament or the primary lamp because the backup light source is not at the same focal point. Even the small change associated with energizing a different filament within the same lamp results in light being produced from a source which is not located at the desired position. Therefore, some compromise in operating characteristics must be made to enable the optical system to continue operating. Thus, the need exists for an optical system which can remain operational with no loss or change in optical characteristics upon the failure of the main light source and energization of a backup light source.

That need has been met by the redundant lamp mechanism disclosed in U.S. patent application Ser. No. 495,246. The mechanism disclosed therein is a mechanical system comprised of various members or links which allow for the movement of a failed lamp from an operative to an inoperative position while simultaneously moving a backup lamp from an inoperative to an operative position. The mode of power disclosed in that application for enabling such movement to occur is a hand crank. There is thus a need for an electric circuit capable of detecting when the primary lamp has failed, energizing the backup lamp, and energizing a motor to enable the energized backup lamp to be automatically and quickly positioned at the desired focal point.

SUMMARY OF THE INVENTION

The present invention is directed to a circuit for energizing one of a first and second lamps and for energizing a motor to position the energized lamp. The circuit is comprised of first and second switches for supplying current to the first and second lamps, respectively. First and second current sensors are provided for producing first and second signals, respectively, when the first and second lamps are energized.

A first driver is responsive to the second signal for providing a driving current to the motor whenever the second lamp is energized. The driving current is steered by steering diodes so as to be applied in a manner to drive the motor's shaft in a direction known to bring the second lamp into the desired position. A second driver is responsive to the first signal for providing a driving current to the motor when the first lamp is energized. The driving current is steered by steering diodes so as to be applied in a manner to drive the motor's shaft in a direction known to bring the first lamp into the desired position.

A first biasing network is responsive to the second signal for inhibiting the operation of the first switch whenever the second switch is conductive. A second biasing network is responsive to the first signal for inhibiting the operation of the second switch whenever the first switch is conductive. Limit switches may be located to interrupt the provision of driving current to the motor when the desired position is reached.

According to one embodiment of the present invention, a lamp burnout detector/indicator is provided in which a pair of LED's, one responsive to each of the lamps, is lit when its respective lamp fails open.

The present invention thus provides an electronic circuit for detecting when a lamp has failed open. In responsive to a lamp failure, a backup lamp is energized. In addition, a motor is energized which, through appropriate mechanical interconnection, can be used to position the backup lamp in the position previously occupied by the primary lamp. Finally, the circuit provides an indication through, for example, LED's that a lamp has failed open. These and other advantages and benefits of the present invention will become apparent from the following description of a preferred embodiment.

BRIEF DESCRIPTION OF THE DRAWINGS

For the present invention to be clearly understood and readily practiced, a preferred embodiment will now be described, by way of example only, with reference to the accompanying figures wherein.

DETAILED DESCRIPTION OF A PREFERRED ENBODIMENT

Figure 1:
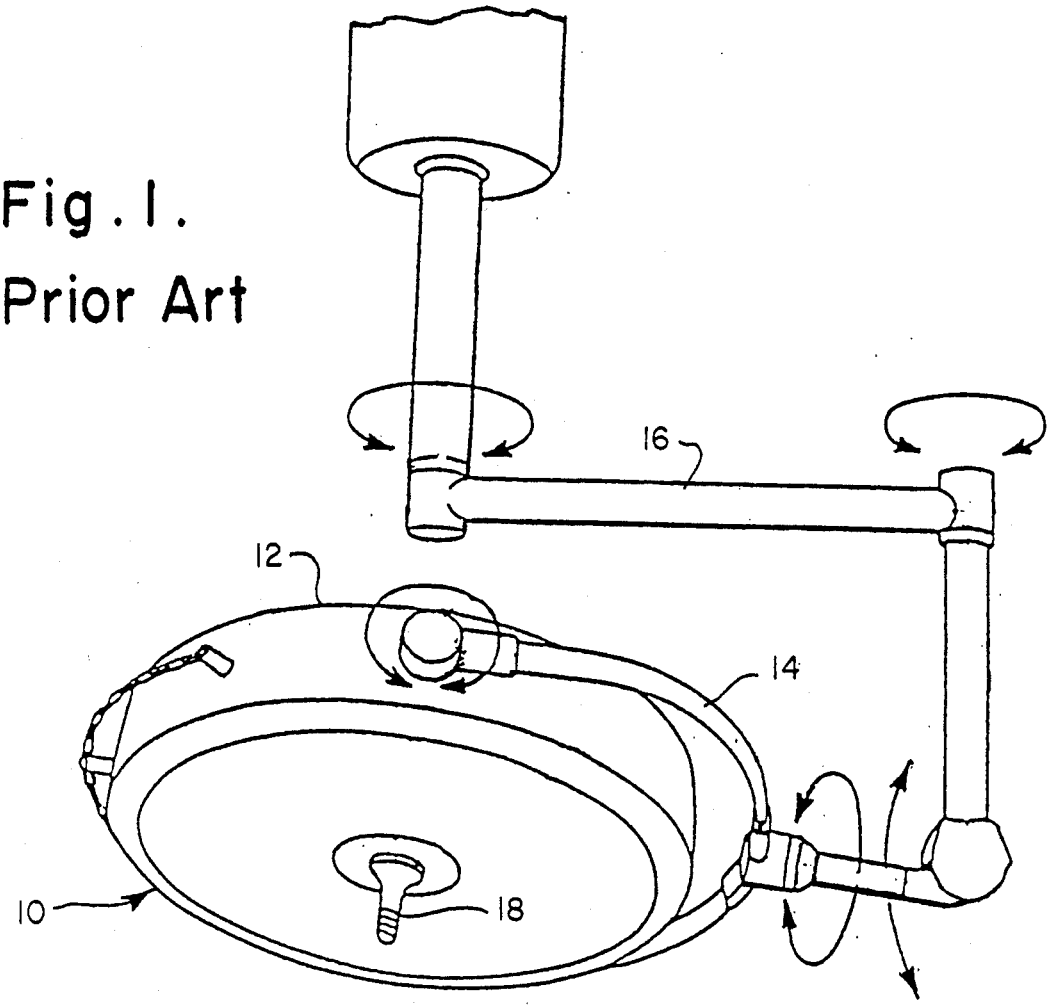
Fig. 1. Prior Art
FIG. 1 illustrates a typical surgical light and suspension system therefor.

The circuit of the present invention may be used in conjunction with a surgical light 10 such as that shown in FIG. 1. The reader will understand that although the present invention will be described in connection with the surgical light 10 of FIG. 1, the present invention may be used in conjunction with other types of optical systems.

The surgical light 10 illustrated in FIG. 1 is comprised of an outer cover 12 which is connected to a yoke 14 as is known. The yoke 14 is connected to a suspension system 16 which, together with the yoke 14, provides several degrees of freedom for the surgical light 10. A sterile handle support 18, designed to support a removable sterile handle cover (not shown), is provided in the center of the surgical light 10 so that the surgeon or sterile nurse may manipulate the surgical light 10 to the desired position.

Figure 4:
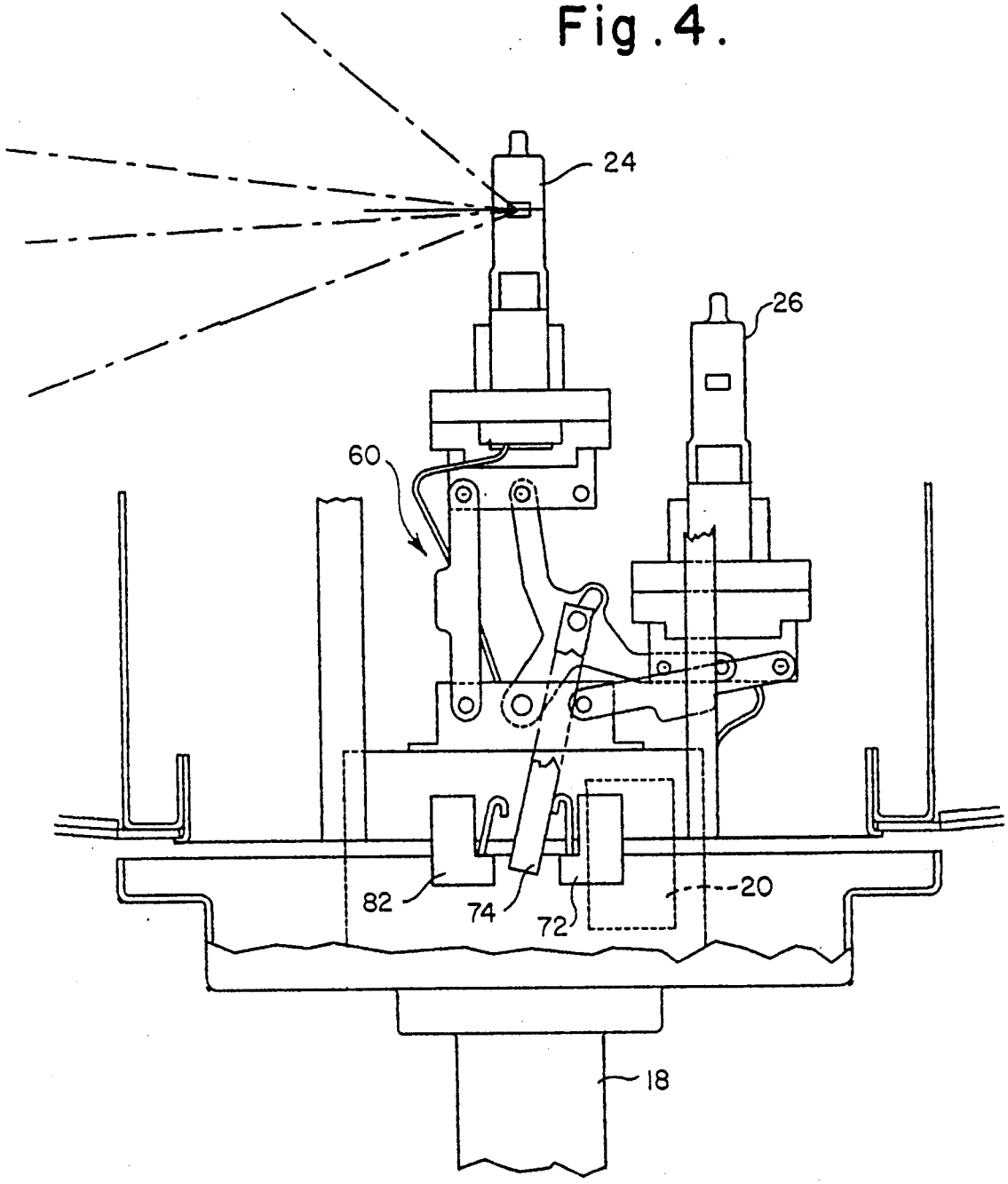
FIGS. 4 and 5 illustrate a mechanism used in conjunction with the circuit of the present invention to position the energized lamp.
Figure 5:
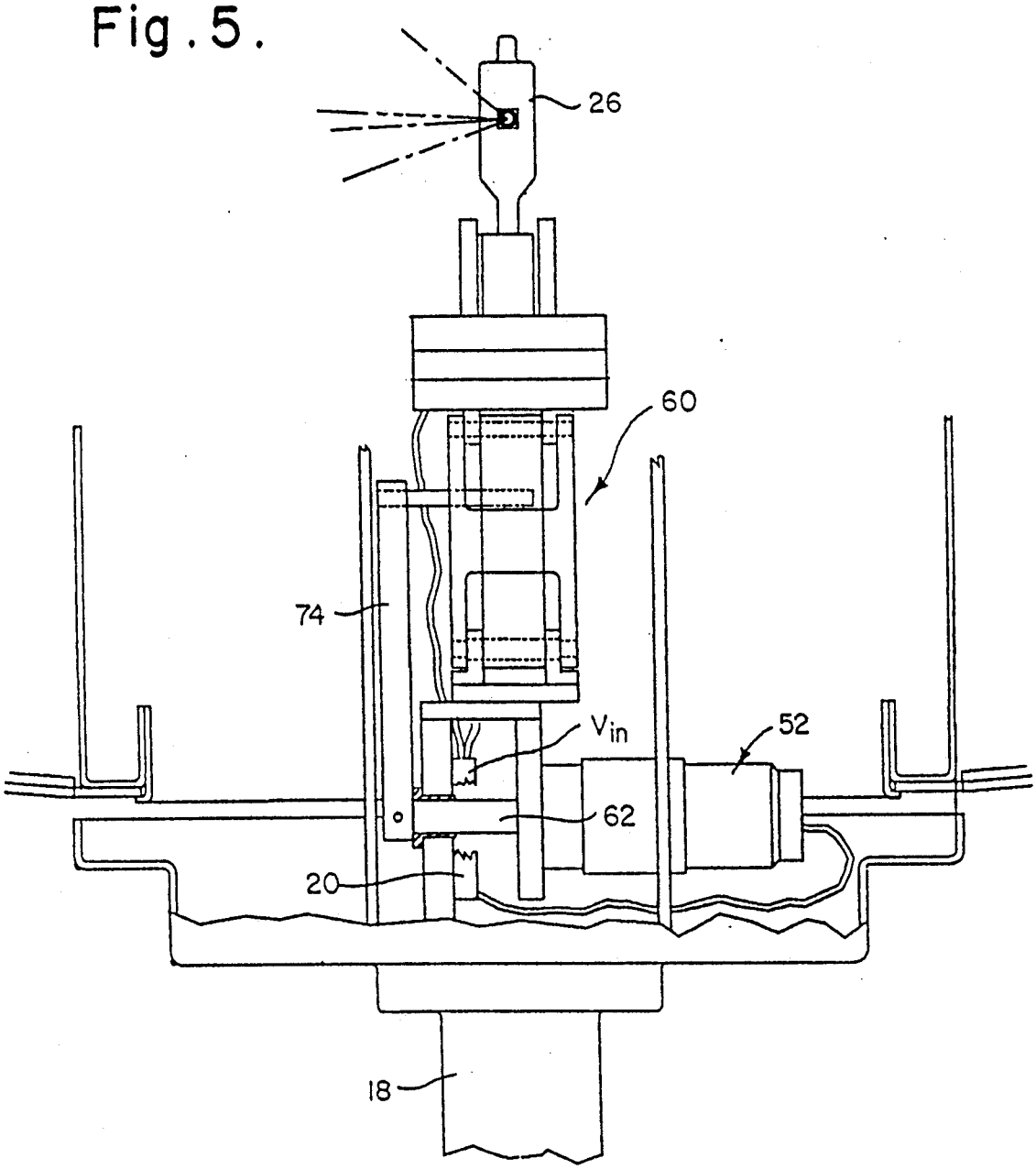

The circuit 20 of the present invention may be located above the sterile handle support 18 as seen in FIGS. 4 and 5. The circuit 20 is illustrated in block diagram form in FIG. 2. A DC input voltage $V_{in}$ is provided by a rectified AC source or battery (not shown) at an input terminal 21. The voltage $V_{in}$ provides voltage to a DC voltage regulator 22 and provides power to a first lamp 24 and a second lamp 26. The DC voltage regulator 22 outputs a regulated voltage $V_r$ which is used throughout the circuit 20.

A first power switch 28 and a second power switch 30 are operated in a bistable multivibrator manner such that when one of the switches is ON or closed, the other switch is OFF or open. When the first power switch 28 is closed, a first lamp current $I_1$ flows through the first lamp 24 causing the first lamp to produce visible light. Similarly, when the second power switch 30 is closed, a second lamp current $I_2$ flows through the second lamp 26 causing the second lamp to produce visible light.

A first current sensor 32 produces an output voltage $V_1$ which is proportional to the first lamp current $I_1$. A second current sensor 34 produces an output voltage $V_2$ which is proportional to the second lamp current $I_2$. A first reference generator 36 produces a first reference signal $V_{ref1}$ which is derived from the regulated voltage $V_r$ and which serves as a threshold voltage for a first comparator 40. A second reference generator 38 produces a second reference voltage $V_{ref2}$ which is derived from the regulated voltage $V_r$ and which serves as a threshold voltage for a second comparator 42.

The comparator 40 produces a first output signal $V_3$ which assumes a high state if $V_1$ is greater than $V_{ref1}$. The second comparator 42 produces a second output signal $V_4$ which assumes a high state if $V_2$ is greater than $V_{ref2}$.

A first biasing network 44 provides a bias to the first power switch 28. The first biasing network 44 is responsive to the second output signal $V_4$ such that when the second output signal assumes a high state, which is indicative that the second power switch 30 is closed and current $I_2$ is flowing through the second lamp 26, the bias is removed from the first power switch 28 thereby rendering it inoperative.

A second biasing network 48 provides a bias to the second power switch 30. The second biasing network 48 is responsive to the first output signal $V_3$ such that when that signal assumes a high state the bias is removed from the second power switch 30 thereby inhibiting its operation.

First and second drivers 46 and 50, respectively, are provided. The drivers form a H-bridge drive circuit, seen more fully in FIG. 3, for driving a DC motor 52 in one of two directions. The first driver 46 produces a drive voltage $V_{dr1}$ while the second driver 50 produces a drive voltage $V_{dr2}$. The DC motor 52 is driven in a clockwise (CW) direction if $V_{dr1}$ is greater than $V_{dr2}$ and in a counter-clockwise (CCW) direction if $V_{dr2}$ is greater than $V_{dr1}$.

Figure 3:
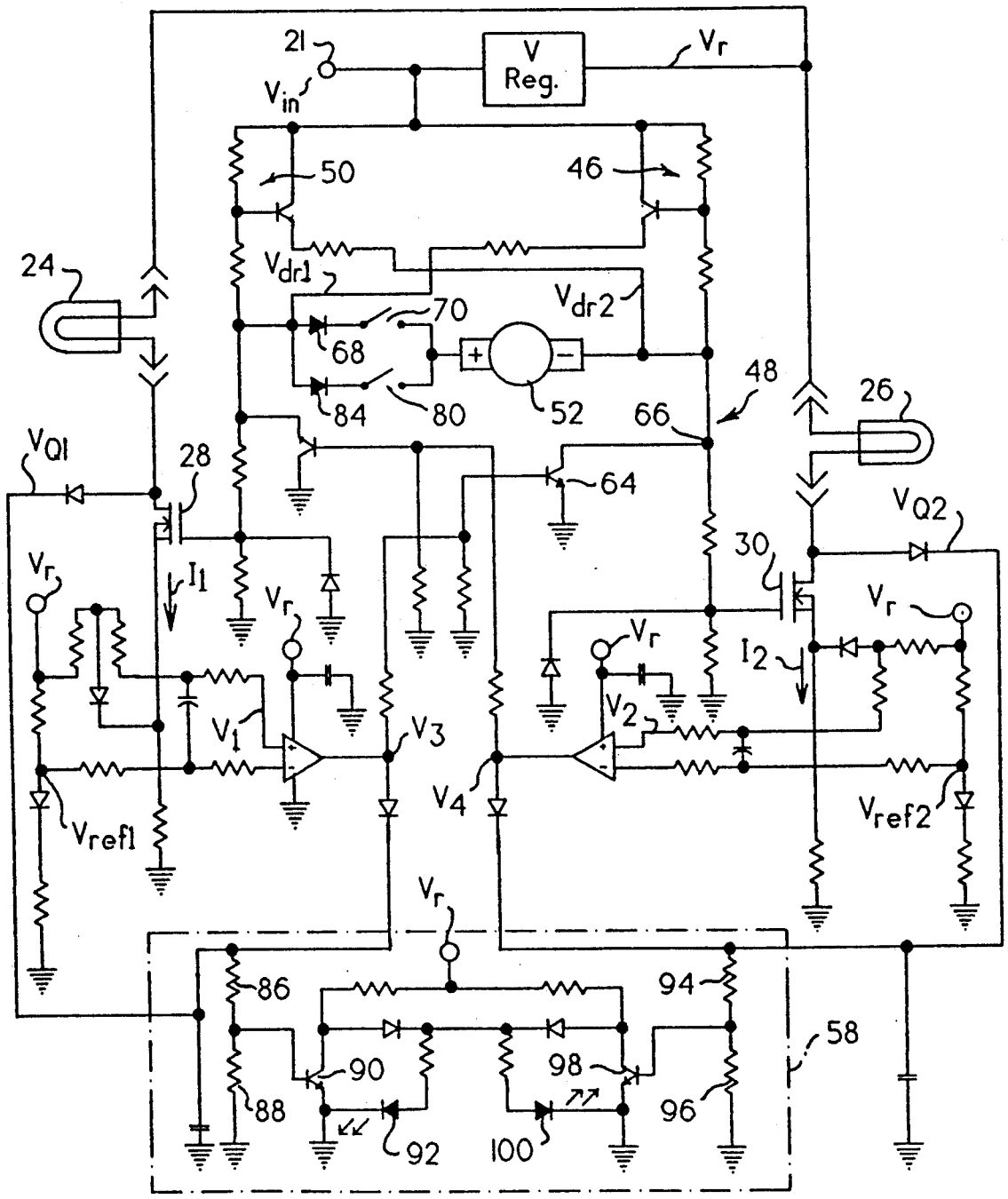
FIG. 3 is an electrical schematic of the circuit illustrated in FIG. 2.

Steering diodes 54, seen best in FIG. 3, direct current flow to limit switches 56, seen in FIGS. 3 and 4, depending upon whether the current has a positive or negative value. The limit switches are normally closed switches which open to interrupt the motor drive current whenever the shaft of the motor has rotated through a sufficient angle as described more fully below in conjunction with FIG. 3.

Figure 2:
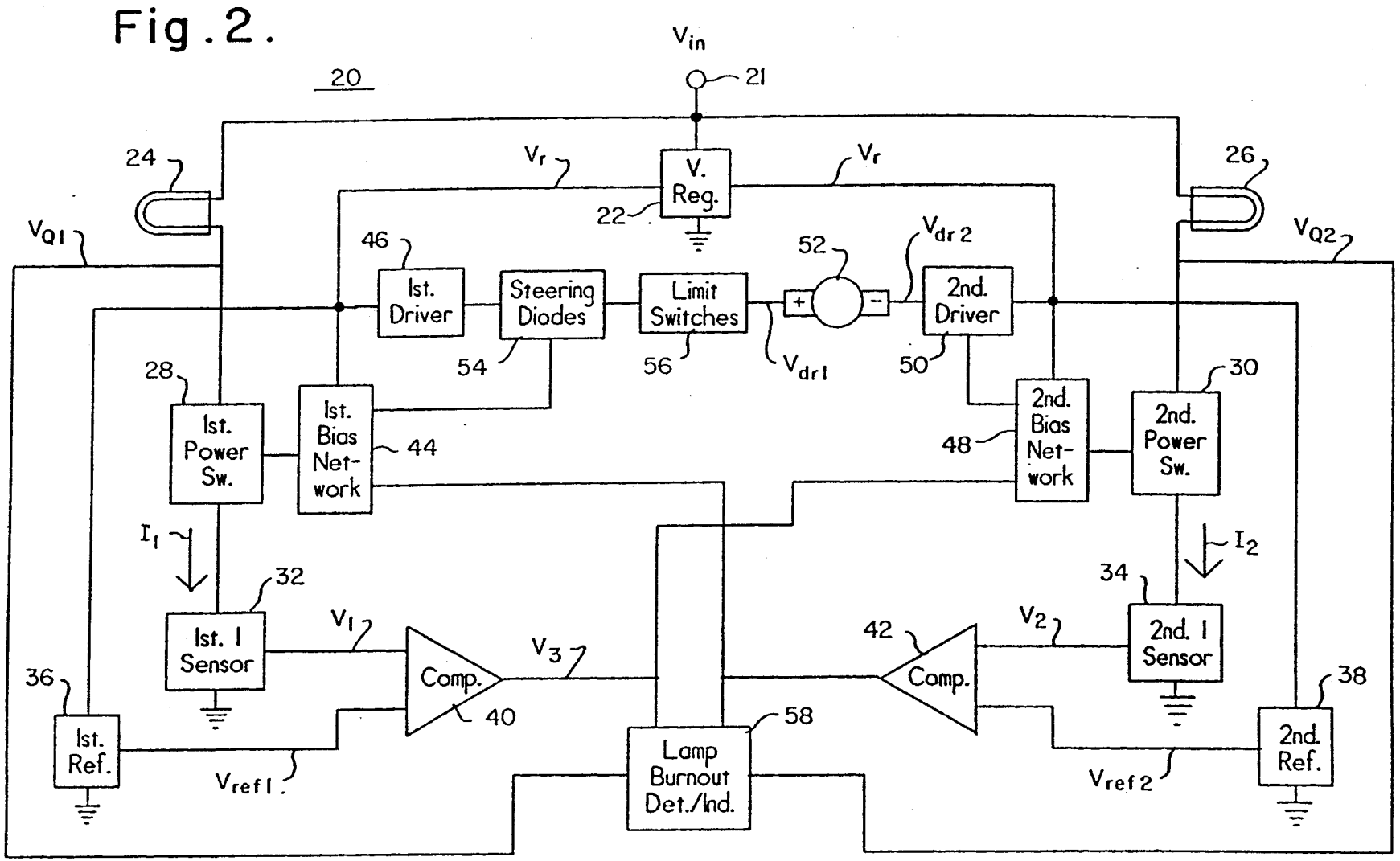
FIG. 2 is a block diagram of a circuit constructed according to the teachings of the present invention for energizing one of two lamps and for energizing a motor to properly position the energized lamp.

Completing the description of the circuit shown in FIG. 2, a lamp burnout detector/indicator circuit 58 is responsive to the first power switch voltage $V_{Q1}$ and the first output signal $V_3$ to maintain a visible indicator in the OFF condition if either $V_{Q1}$ or $V_3$ is in a high state. Should lamp 24 fail open, both of the aforementioned voltages assumes a low state thereby enabling the visible indicator to be lit.

The lamp burnout detector/indicator 58 is also responsive to the second power switch voltage $V_{Q2}$ and the second output signal $V_4$ to maintain a visible indicator in the OFF condition if either of those voltages is in a high state. Should lamp 26 fail open, both of the aforementioned voltages assume a low state thereby enabling the visible indicator to be lit.

The circuit 20 of the present invention may be used in conjunction with a mechanism 60 seen in FIGS. 4 and 5. The mechanism 60 provides a mechanical linkage between a shaft 62 of the DC motor 52 and the first and second lamps 24 and 26, respectively. The mechanism 60 does not form a part of the present invention. Any suitable mechanism may be used to couple the rotation of the shaft 62 to affect movement of the lamp 24 from an operative to an inoperative position while moving the lamp 26 from an inoperative to an operative position, or vice versa. The reader desiring more details regarding mechanism 60 is directed to co-pending U.S. patent application Ser. No. 495,246, which is hereby incorporated by reference.

The operation of the circuit 20 will now be described in detail in conjunction with FIG. 3. When the input voltage $V_{in}$ is applied, either the first power switch 28, through its associated biasing network 44, will become conductive energizing lamp 24 or the second power switch 30, through its associated biasing network 48, will become conductive energizing lamp 26. The lamp that is energized is a function of the gain of the first and second power switches 28 and 30. The gains can be set at substantially the same values so that upon initial turn-on the selection of the lamp to be energized occurs randomly, or one of the switches can be adjusted to have a higher gain so that the same lamp is always energized at turn-on.

Assuming that first power switch 28 is closed energizing lamp 24, the value of the voltage $V_1$ produced by the first current sensor 32 will exceed the value of the voltage $V_{ref1}$ thereby driving the first output signal $V_3$ to a high state. With the voltage $V_3$ in a high state, a transistor 64 is rendered conductive. When the transistor 64 becomes conductive, a node 66 within the second biasing network 48 is grounded. By grounding the node 66, the second power switch 30 is rendered inoperative. As a result, the second lamp 26 is held in an unenergized state.

With the node 66 grounded, the voltage $V_{dr1}$ is greater than the voltage $V_{dr2}$ and a current flows through a first steering diode 68, the normally closed contacts 70 of a first limit switch 72, and the motor 50 to the grounded node 66. By thus energizing the motor 52, the shaft of the motor rotates in a clockwise direction as seen in FIG. 4 until a mechanical linkage 74 contacts the limit switch 72 thereby opening the normally closed contacts 70. When the normally closed contacts 70 are opened, the motor 52 is deenergized. As can be seen in FIG. 4, with the mechanical linkage 74 in the position shown, the energized lamp 24 is at a desired position within the optical system.

From the foregoing discussion it will be apparent that if the lamp 24 was already in the position shown in FIG. 4, it would have been unnecessary to energize motor 52. In fact, if the lamp 24 was already in the position shown in FIG. 4, the normally closed contacts 70 would already have been open such that the motor could not have been energized.

Those of ordinary skill in the art will understand that the circuit 20 operates in a similar fashion in the event that lamp 26 is the lamp which is energized. Under that condition, the value of voltage $V_2$ exceeds the value of the voltage $V_{ref2}$ such that the value of the second output signal $V_4$ is driven to a high state. With $V_4$ high, a transistor 76 becomes conductive. With the transistor 76 conductive, a node 78 within the first biasing network 44 is grounded. When the node 78 grounded, the voltage $V_{dr2}$ is greater than the voltage $V_{dr1}$. That condition allows current to flow through the motor 52, a normally closed contact 80 of a second limit switch 82 shown in FIG. 4, and a steering diode 84 to the grounded node 78. The motor 52 will remain energized until the linkage 74 contacts the second limit switch 82 thereby opening the normally closed contact 80.

The lamp burnout detector/indicator 58 is shown at the bottom of FIG. 3. The voltages $V_{Q1}$ and $V_3$ are applied across a pair of series connected resistors 86 and 88. The junction point between the resistors 86 and 88 is connected to the base of a transistor 90. The transistor 90 is interconnected with a first LED 92 in such a manner that if either $V_{Q1}$ or $V_3$ is in a high state, the transistor 90 holds the LED 92 in a nonconductive state. When both $V_{Q1}$ and $V_3$ assume a low state, which occurs when lamp 24 fails open, LED 92 is rendered conductive thereby providing a visible indication of the open failure of lamp 24.

Assuming that the lamp 24 occupies the position shown in FIG. 4, and is energized, should lamp 24 fail open, the first output voltage $V_3$ assumes a low state which renders transistor 64 nonconductive. With transistor 64 nonconductive, the biasing network 48 operates to close the second power switch 30. With the second power switch 30 closed, the current $I_2$ flows thereby energizing the second lamp 26.

With the second lamp current $I_2$ flowing, the second output voltage $V_4$ assumes a high state rendering the transistor 76 conductive. With the transistor 76 conductive, the node 78 is grounded. That allows the second driver 50 to produce a drive current that flows through motor 52, normally closed contact 80, and steering diode 84 to ground. The normally closed contact 70 is open because the mechanical linkage 74 occupies the position shown in FIG. 4. With current flowing through the motor 52, the shaft 62 of the motor rotates in a counterclockwise direction moving the linkage 74 out of engagement with limit switch 72 and into engagement with limit switch 82. When the linkage 74 engages limit switch 82, the normally closed contact 80 is opened thereby deenergizing the motor 52. The normally closed contact 70 of the limit switch 72 returns to its normal state as soon as the linkage 74 moves out of engagement therewith.

With the lamp 24 failed open, the voltage $V_{Q1}$ assumes a low state. Additionally, with the first lamp current $I_1$ no longer flowing, the first output voltage $V_3$ assumes a low state. With both of those voltages in a low state, the first LED 92 is rendered conductive to produce a visible output signal indicative of the failure of lamp 24.

The present invention thus recognizes the failure of the first lamp 24, energizes the second lamp 26, energizes the motor 52 to enable the second lamp 26 to be moved to the desired position, and provides a visible indication through LED 92 that the first lamp 24 has failed. When the failed lamp is replaced with power removed from circuit 20, the new lamp 24 will be moved to the optimum optical location if the first power switch 28 has a higher gain than the second power switch 30. Under such conditions, operation of the second lamp 26 is thus minimized and its operational condition is preserved if the failed lamp 24 is replaced within a short time relative to the rated lamp life. Should the gain of the first and second power switches be substantially equal such that the lamp to be energized is randomly selected, whenever one lamp fails its is desirable to replace both lamps.

While the present invention has been described in connection with an exemplary embodiment thereof, it will be understood that many modifications and variations will be readily apparent to those of ordinary skill in the art. This disclosure and the following claims are intended to cover all such modifications and variations.

What we claim is:

1. A circuit for energizing one of a first and second lamps and for energizing a motor to position the energized lamp, said circuit comprising:

first and second switch means for supplying current to the first and second lamps, respectively;

first and second current sensing means for producing first and second signals, respectively, when the first and second lamps are energized;

a first driver responsive to said second signal for providing a driving current to the motor when the second lamp is energized;

a second driver responsive to said first signal for providing a driving current to the motor when the first lamp is energized;

a first biasing network responsive to said second signal for inhibiting the operation of said first switch means; and a second biasing network responsive to said first signal for inhibiting the operation of said second switch means.

2. The circuit of claim 1 additionally comprising a pair of steering diodes connected between said first and second drivers and the motor to insure proper application of driving current to the motor.

3. The circuit of claim 2 additionally comprising a pair of limit switches connected between said steering diodes and the motor to interrupt the application of driving current to the motor.

4. The circuit of claim 1 additionally comprising a lamp burnout detector/indicator responsive to the voltage across said first and second switch means and said first and second signals to provide an indication if either of said first and second lamps fails open.

5. The circuit of claim 4 wherein said lamp burnout detector/indictor circuit includes a first light emitting diode held in a nonconductive state by one of said voltage across said first switch means and said first signal being in a high state and a second light emitting diode held in a nonconductive state by one of said voltage across said second switch means and said second signal being in a high state.

* * * * *